United States Patent [19]

Tanaka et al.

[11] Patent Number: 4,790,476

[45] Date of Patent: Dec. 13, 1988

[54] MONEY-COLLECTING DEVICE

[75] Inventors: Akito Tanaka; Kazuhito Kimura, both of Himeji, Japan

[73] Assignee: Glory Kogyo Kabushiki Kaisha, Hyogo, Japan

[21] Appl. No.: 162,103

[22] Filed: Feb. 29, 1988

[30] Foreign Application Priority Data

Mar. 2, 1987 [JP] Japan ..... 62-30845

[51] Int. Cl.[4] ..... B65D 91/00

[52] U.S. Cl. ..... 232/1 D; 232/43.2

[58] Field of Search ..... 232/43.1, 1 D, 43.2, 232/43.5; 211/51

[56] References Cited

U.S. PATENT DOCUMENTS

| | | | |
|---|---|---|---|
| 1,684,188 | 9/1928 | Merrin | 211/51 X |
| 3,212,667 | 10/1965 | Kleist et al. | 211/51 X |
| 3,292,849 | 12/1966 | Ewing | 232/43.2 |
| 3,724,400 | 4/1973 | Steiber | 232/43.2 X |
| 4,548,353 | 10/1985 | Honard et al. | 232/43.2 X |

*Primary Examiner*—Robert W. Gibson, Jr.

*Attorney, Agent, or Firm*—Wenderoth, Lind & Ponack

[57] ABSTRACT

A money-collecting device of box type having at its top a slot across which a bill is transversely laid, then folded and inserted into the device by an insertion plate further has two guide members having respective lower end parts closely confronting each other and aligned below and parallelly to the slot at a height position above the upwardly directed two ends of the bill after the bill has been thus thrust downward between and completely past said lower end parts by said insertion plate inserted to the lowermost position thereof, said guide members further having repective guiding parts flaring substantially symmetrically upward from said lower end parts and outward. A receiving platform is supported horizontally in a manner permitting ascent and descent thereof within the device and functions to support bills thus inserted in succession. The receiving platform is urged upward continually as by a spring.

9 Claims, 6 Drawing Sheets

MONEY-COLLECTING DEVICE

BACKGROUND OF THE INVENTION

This invention relates to money-collecting devices such as those mounted in or attached to gaming tables in places such as casinos, for example. More particularly, the invention relates to a money-collecting device of a box-shaped structure having at its top a slot through which paper money or bills can be inserted in folded state by an insertion plate into a receiving chamber, and through which coins, tokens, chips, and the like (hereinafter referred to collectively as coins) can also be dropped to be collected in a door part of the money-collecting device.

Gaming tables used in places such as casinos for games of chance are generally provided with money-collecting devices for collecting and holding bills and coins. Ordinarily, a device of this character is mounted in the manner of a drawer below the table top of a gaming table and has through its top a money insertion slot which, when the device is thus mounted in place, is disposed immediately below and aligned with a similar slot opening in the table top. A bill or coin inserted into the table top slot therefore enters the device through the slot at its top. When a bill is to be inserted, it is laid across the slot opening in the table top and is thrust into and through the two slots by means of an insertion plate applied along a transverse line at the middle part of the bill. Coins are merely dropped through the slots. The money-collecting device, containing the bills and coins thus collected, is drawn out from below the gaming table and carried to an accounting station and deposited.

In a conventional money-collecting device of this character, however, the bills are collected therein in their as-inserted folded and disorderly state and, moreover, mixed with coins. Consequently, the work of taking these bills and coins out and processing them has been extremely troublesome and time consuming. Particularly in the case where the collected bills are to be processed in a bill processing machine, the bills, which have been thrust in their folded state into the device, must be unfolded and spread flat sheet by sheet and then stacked neatly. Therefore, the use of a conventional money-collecting device of this character inevitably results in a very low efficiency of money processing subsequent to their collection.

SUMMARY OF THE INVENTION

It is an object of this invention, which has been made in view of the above described problems, to provide a money-collecting device in which each bill inserted in folded state by an insertion plate is automatically unfolded, spread flat, and collected in a neat stack, and in which, moreover, coins dropped into the same slot as the bills are guided into a collecting chamber separate from that for the bills.

According to this invention there is provided a money-collecting device comprising in combination: a box structure having an interior serving as a currency bill receiving chamber and a ceiling panel provided therethrough with a slot for insertion therethrough of money and the like from outside into said interior; an insertion plate for thrusting from above a currency bill which has been laid transversely across the top of said slot downward in folded state through the slot and into the interior; two guide members having respective lower end parts closely confronting each other and aligned below and parallelly to the slot at a height position above the upwardly directed two ends of the bill after the bill has been thus thrust downward between and completely past said lower end parts by said insertion plate inserted to the lowermost position thereof, said guide members further having respective guiding parts flaring substantially symmetrically upward from said lower end parts and outward; a receiving platform supported horizontally in a manner permitting ascent and descent thereof within said interior and functioning to support bills thus inserted in succession; and lifting means for continually applying a force urging said platform to ascent toward said lower end parts.

In the operation of the money-collecting device of the above described organization according to the invention, the insertion plate, after thrusting the bill in folded state downward between and past said lower end parts, presses the receiving platform downward against the counter force of said lifting means until said upwardly directed ends of the bill have slipped past and clear of said lower end parts, and then, when the insertion plate is withdrawn upward from said lowermost position, the receiving platform and the bill ascend in a following manner, said ends of the bill thereby being forced apart by said guiding parts in unfolding movement until the bill is lying in flat state and pressed against said lower end parts by the receiving platform, succeeding bills similarly inserted thereby being deposited in a neat stack thereof on said receiving platform.

According to this invention in another aspect thereof, there is provided a money-collecting device as described above which further comprises a door structure supported in a manner by said box structure to close and open one vertical wall part thereof and having a hollow interior serving as a coin receiving chamber and a coin receiving opening formed at an upper inner side of the door structure and communicating with said coin receiving chamber and two spring plates secured along upper edges thereof to the lower side of said ceiling panel on respective opposite longitudinal sides of said slot and extending downward to converge at the lower parts thereof to mutually abut at the lower edges thereof along a line immediately below and parallel to the slot, thereby forming therebetween a trough with a Vee bottom in cross section sloping downwardly toward said coin receiving opening, said spring plates being disposed above said guide members and, at the time of insertion of a bill by the insertion plate, being forced apart along said Vee bottom to permit passage therethrough of said bill and insertion plate, whereby, when a coin or the like is dropped into the slot, said coin or the like is guided along the sloping trough toward and into said coin receiving opening to be received in said coin receiving chamber.

The nature, utility, and further features of this invention will be more clearly apparent from the following detailed description with respect to one embodiment of the invention when read in conjunction with the accompanying drawings briefly described below.

DETAILED DESCRIPTION OF THE INVENTION

Figure 1:
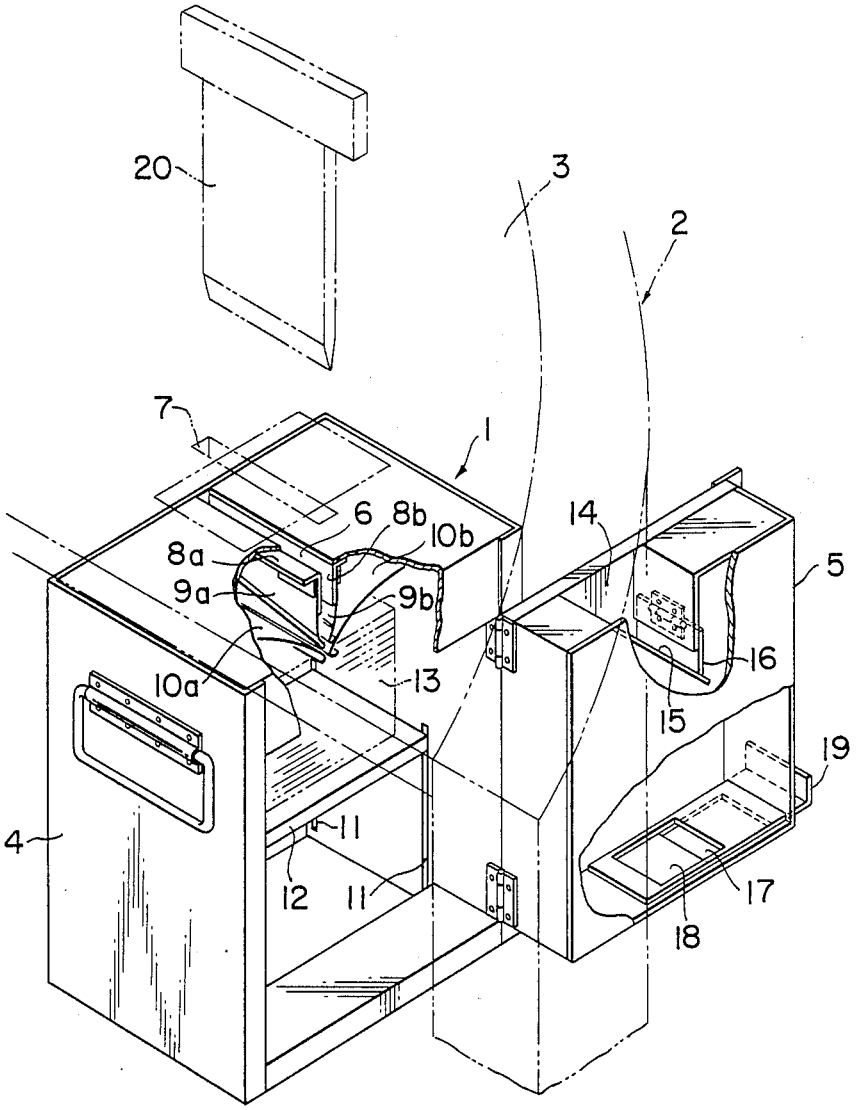
FIG. 1 is a perspective view, with parts cut away, showing a money-collecting device embodying the principle of this invention with its door part in opened state.

As shown in FIG. 1, a preferred form of the money-collecting device 1 of this invention is designed to be mounted for operation in the state of a drawer below the table top 3 of a gaming table 2. The housing or frame structure of this device 1 comprises a box part 4 in which a bill-receiving section is formed and a door part 5 in which a coin-receiving section is formed. Through the ceiling or top panel of the box part 4 is formed a slot 6 for insertion of money therethrough from above into the box part 4. This slot 6 is so positioned on the box part 4 that, when the money-collecting device 1 is in its mounted state relative to the gaming table 2, the slot 6 will be directly below and aligned with an insertion slot 7 formed through the table top 3. The dimensions of the two slots 6 and 7, which are substantially the same, are amply large for insertion therethrough of bills and coins in the manner described hereinafter.

Along the two opposed lips of the slot 6, on the lower or inner side thereof, are respectively attached a pair of parallel guide plates 8*a* and 8*b*, which have downwardly extending flange parts. To these flange parts of the guide plates 8*a* and 8*b* are fixed the upper parts of a pair of spring plates 9*a* and 9*b* which are substantially parallel at their upper portions but converge at their lower portions to mutually abut at their loewr edges along a line immediately below and parallel to the slot 6, thereby forming therebetween a trough with a Vee bottom in cross section sloping downwardly toward the door part 5 as indicated at 9*c* in FIG. 2.

Figure 3:
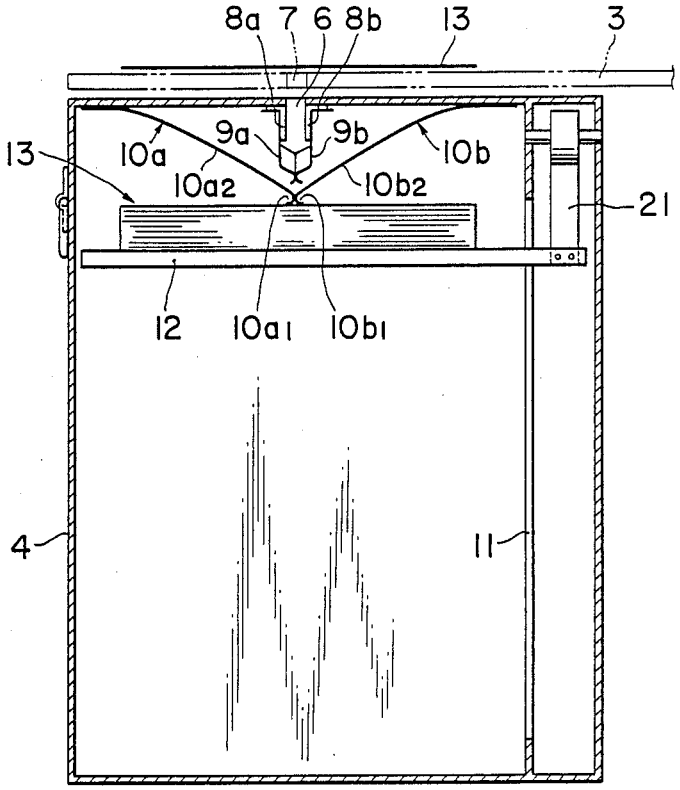
FIG. 3 is a front elevation, in vertical section, showing the device in its stationary standby state of readiness for money receiving operation.

As most clearly shown in FIG. 3, below the spring plates 9*a* and 9*b*, a pair of guide members 10*a* and 10*b* are provided to extend respectively from the two side walls of the box structure 4 at its ceiling inward and downward to mutually abut at their lower end parts $10_{a1}$ and $10_{b1}$ along a line immediately below and parallel to the slot 6. These guide members $10_a$ and $10_b$ are formed from sheet spring material and respectively have gently curved guide parts $10_{a2}$ and $10_{b2}$ which are flared upwardly and laterally from their lower parts toward the ceiling of the box part 4, and which function as bill unfolding members as will be described hereinafter.

Figure 2:
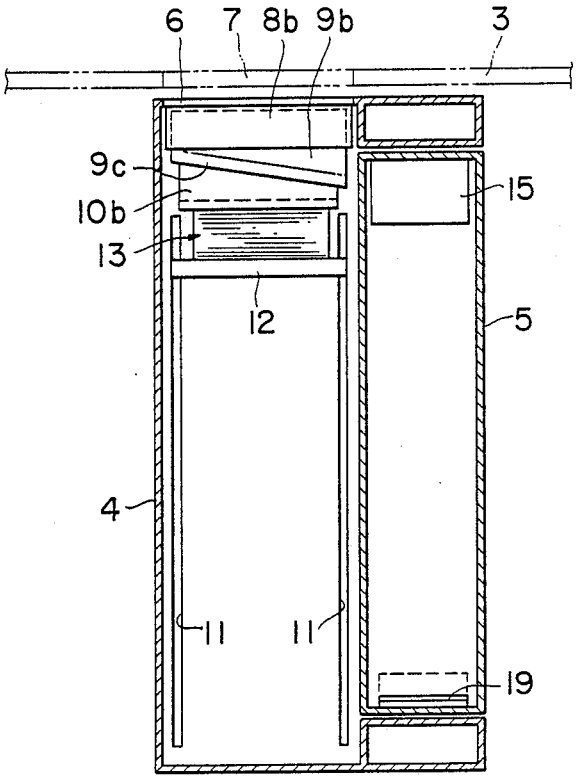
FIG. 2 is a left side elevation, in vertical section, of the device with its door part closed.

As shown in FIGS. 1 and 2, a pair of vertical guide slots 11, 11 are formed parallelly through and along opposite vertical sides of one of the side walls (a right-hand inner wall in this preferred form) of the box structure 4. Below the guide members $10_a$ and $10_b$, a receiving platform 12 for receiving and supporting bills is provided and has projecting parts at its right-hand corners which extend through and are guided by the guide slots 11, 11, the platform 12 thus being free to ascend and descend. As shown in FIG. 3, the platform 12 is continually urged upward by a known constant-force spring 21 fixed at its lower end to the above mentioned projecting parts of the platform 12. Bills 13 which have been unfolded and spread are stacked on this receiving platform 12 as described hereinafter.

The door part 5 is also of box shape and is hinge-connected at its one side to a side wall of the box structure 4 so as to close and open the front side thereof. The door part 5 is provided at its upper part at a position to confront the front end of the aforementioned trough formed between the spring plates $9_a$ and $9_b$ with an opening 14 for receiving coins. Along this opening 14 is provided an inclined guide plate 15 for guiding coins into the interior of the door part 5. A gate plate 16 is hinge-connected along its upper edge to a part of the door structure 5 at a position facing the lower edge of the guide plate 15 and is adapted to be pushed open by coins thus guided. The bottom of the door part 5 is provided with a sliding shutter 19 having a window aperture 18 at a position to overlappingly coincide with a coin take-out opening 17 of the door part bottom when the shutter 18 is in its pulled-out position.

The money-colleting device 1 of the above described construction according to this invention is used and operates in the following manner to collect bills and coins.

Figure 4:
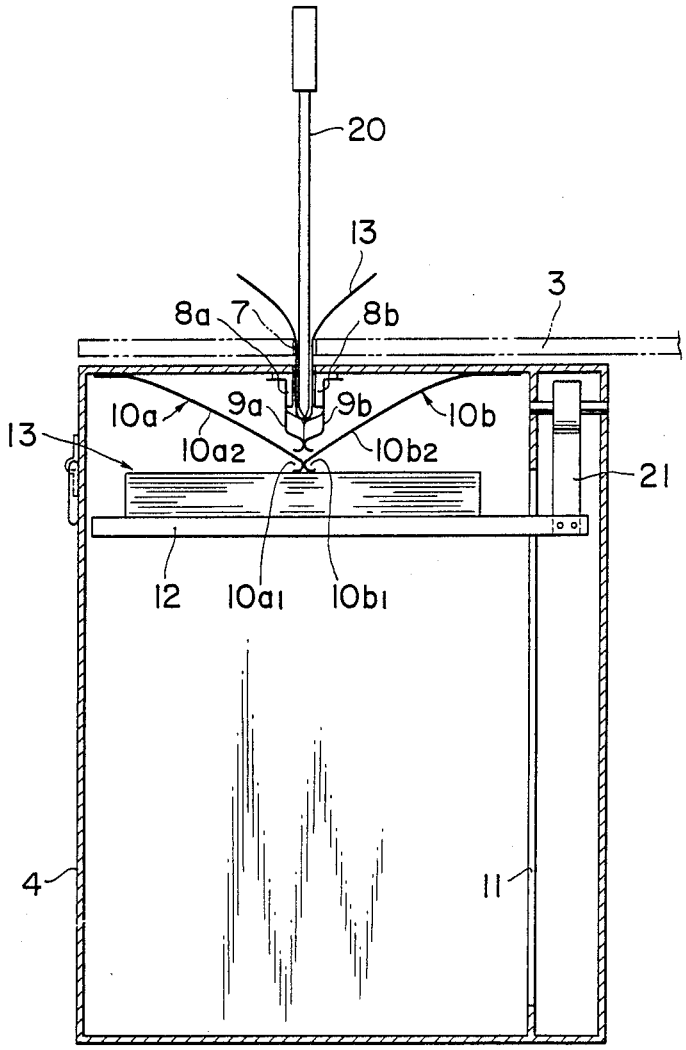
FIGS. 4, 5, and 6 are front elevations similar to FIG. 3 indicating stages in the operation of insertion of a bill into the device and the automatic action of unfolding and spreading the bill after its insertion.

First, the handling of a bill 13 will be described. As shown in FIG. 3, the bill 13 is laid perpendicularly across the insertion slot 7 of the table top 3 so that the middle part of the bill 13 is immediately above the insertion slot 7. At this time, the receiving platform 12 is in a state wherein, because of the upward force exerted thereon by the spring 21, the state of bills 13 resting thereon is being pressed upward against the confronting lower end parts $10_{a1}$ and $10_{b1}$ of the guide members $10_a$ and $10_b$. Next, as shown in FIG. 4, the middle part of the bill 13 laid on the table top 3 across the insertion slot 7 is pressed downward by an insertion plate 20 into the slot 7 and is thereby transversely folded and thus thrust into and through the slot 6 of the money-collecting device 1.

Figure 5:
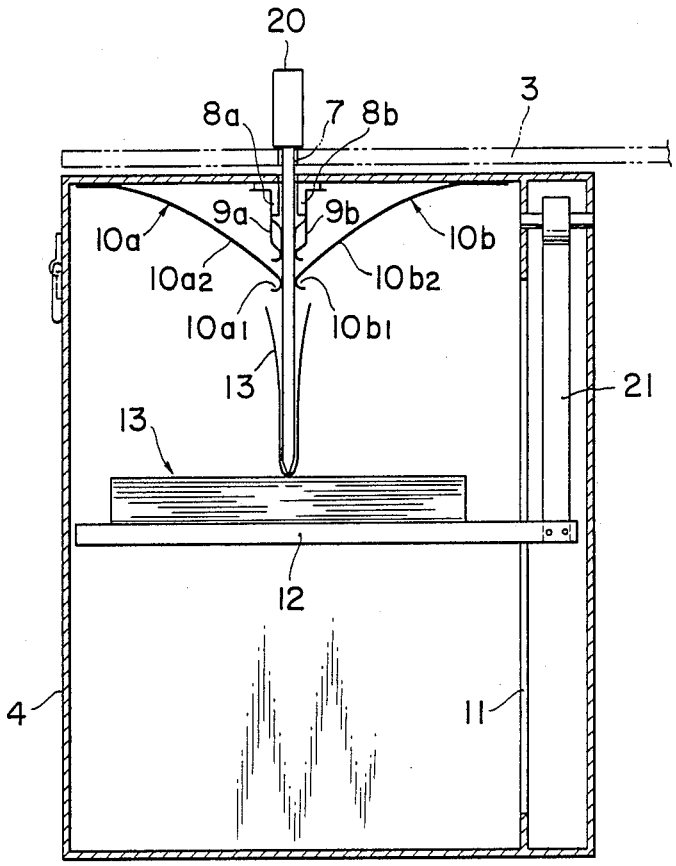

As the insertion plate 20 is inserted further downward, it presses the folded bill 13 into the trough between the pair of spring plates $9_a$ and $9_b$ and then forces these spring plates apart to open the bottom of the trough. The folded bill is thereby thrust downward through this opening and past the lower lips of the spring plates $9_a$ and $9_b$. The still descending insertion plate 20 then similarly forces apart the lower end parts $10_{a1}$ and $10_{b1}$ of the guide members $10_a$ and $10_b$ and presses the folded bill 13 against the stack of bills 13 resting on the receiving platform 12 to press the folded bill 13, the stack of bills 13, and the platform 12 downward against the counter force of the spring 21. When the insertion plate 20 has been fully inserted as shown in FIG. 5, the bill 13 in folded state has been thrust past and clear of the guide members $10_a$ and $10_b$ and is fully within the box part 4. At this time, therefore, the two free ends of this bill 13 are disposed below the lower end parts $10_{a1}$ and $10_{b1}$ of the guide members $10_a$ and $10_b$ and, being unrestrained, tend to separate somewhat to the left and right away from the insertion plate 20 in unfolding directions because of small residual elastic force in the bill 13 and gravity.

Figure 6:
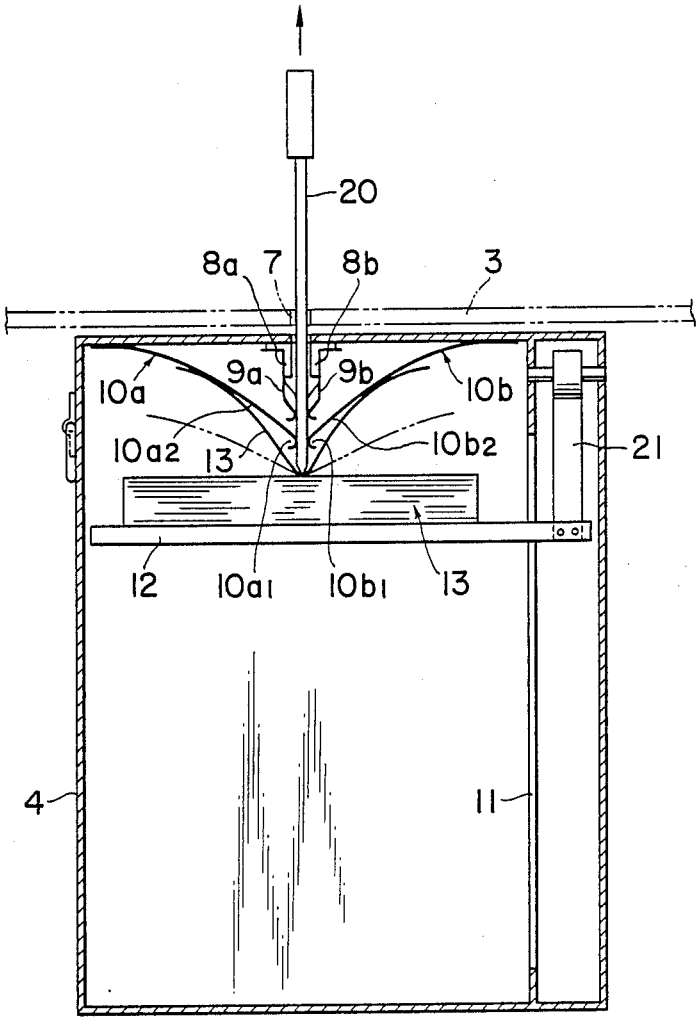

The insertion plate 20 is then withdrawn upward, whereupon, as indicated in FIG. 6, the receiving platform 12 is caused by the spring 21 to rise as though to follow the retracting insertion plate 20. As a consequence, the bill 13 in slightly unfolded state is pushed upward, and its free ends, which can no longer be interposed between the lower end parts $10_{a1}$ and $10_{b1}$ of the guide members $10_a$ and $10_b$ and the insertion plate 20, are respectively spread apart by the curved lower surfaces of the guiding parts $10_{a2}$ and $10_{b2}$ of the guide members $10_a$ and $10_b$ until the bill 13 is fully unfolded as the uppermost sheet of the stack of bills, which is pressed into abutment against the lower end parts $10_{a1}$ and $10_{b1}$ of the guide members $10_a$ and $10_b$ by the platform 12 under the force of the spring 21. In this manner, the bills 13 are inserted into the box part 4 and successively unfolded and laid in a neat stack on the receiving platform 12.

In addition, currency items such as coins, other than paper bills, are also inserted through the insertion slot 7. These coins and the like are guided by the sloped bottom $9_c$ of the trough formed between the spring plates $9_a$ and $9_b$ and drop into the coin receiving opening 14 at the upper part of the door part 5. The coins thus fall onto the guide plate 15, slide along this plate 15, push open the gate plate 16, and drop into the coin collecting space within the door part 5.

When the money items thus collected are to gathered, counted, and deposited, the money-collecting device 1 is taken out of the gaming table 2 and carried to an accounting station, where the door part 5 is opened, and the stacked bills are taken out. The coins and the like are taken out by pulling the shutter 19 outward.

While, in the above described preferred form, the guide members $10_a$ and $10_b$ for unfolding and spreading bills are formed from leaf spring material, they can also be fabricated from a thin rigid sheet material. In such a case, the transverse gap between the mutually opposed lwoer edges of the pair of guide members is preferably made the minimum which will permit the passage therethrough of a bill together with the insertion plate.

As will be apparent from the foregoing disclosure, a bill which has been folded and inserted by an insertion plate into a money-collecting device according to this invention is automatically unfolded and spread flat within the receiver. Moreover, a large number of bills are thus deposited in a neat stack, whereby the processing of the bills after collection can be carried out efficiently. Furthermore, coins and the like are dropped into the same slot as the bills and yet can be collected separately from the bills.

What is claimed is:

1. A money-collecting device comprising in combination:

a box structure having an interior serving as a currency bill receiving chamber and a ceiling panel provided therethrough with a slot for insertion therethrough of money and the like from outside into said interior;

an insertion plate for thrusting from above a currency bill which has been laid transversely across the top of said slot downward in folded state through the slot and into the interior;

two guide members having respective lower end parts closely confronting each other and aligned below and parallelly to the slot at a height position above the upwardly directed two ends of the bill after the bill has been thus thrust downward between and completely past said lower end parts by said insertion plate inserted to the lowermost position thereof, said guide members further having respective guiding parts flaring substantially symmetrically upward from said lower end parts and outward;

a receiving platform supported horizontally in a manner permitting ascent and descent thereof within said interior and functioning to support bills thus inserted in succession; and lifting means for continually applying a force urging said platform to ascent toward said lower end parts, whereby the insertion plate, after thrusting the bill in folded state downward between and past said lower end parts, presses the receiving platform downward against the counter force of said lifting means until said upwardly directed ends of the bill have slipped past and clear of said lower end parts, and then, when the insertion plate is withdrawn upward from said lowermost position, the receiving platform and the bill ascend in a following manner, said ends of the bill thereby being forced apart by said guiding parts in unfolding movement until the bill is lying in flat state and pressed against said lower end parts by the receiving platform, succeeding bills similarly inserted thereby being deposited in a neat stack thereof on said receiving platform.

2. A money collecting device according to claim 1 wherein said guide members are made from leaf spring material.

3. A money collecting device according to claim 1 wherein said guide members are made from a thin rigid sheet material.

4. A money collecting device according to claim 1 wherein said lifting means is spring means.

5. A money collecting device according to claim 1, further comprising a pair of opposing spring plates extending downward from said slot so as to form therebetween and below the slot a trough with a Vee bottom in cross section.

6. A money collecting device according to claim 5 wherein said Vee bottom of the trough slopes downwardly in one longitudinal direction thereof, thus having a lowest bottom part at one end, whereby currency items such as coins inserted into the slot are guided by the inner walls of the trough and moved to said one end of the trough from where they are sent to coin receiving means.

7. A money collecting device according to claim 6, further comprising a door structure disposed to close and open said box structure and supporting said coin receiving means adjacent to said one end of the trough when the door structure is in a closing position.

8. A money-collecting device according to claim 1 further comprising: a door structure supported by said box structure in a manner to close and open one vertical wall part thereof and having a hollow interior serving as a coin receiving chamber and a coin receiving opening formed at an upper inner side of the door structure and communicating with said coin receiving chamber; and two spring plates secured along upper edges thereof to the lower side of said ceiling panel of the box structure on respective opposite longitudinal sides of said slot and extending downward to converge at the lower parts thereof to mutually abut at the lower edges thereof along a line immediately below and parallel to the slot, thereby forming therebetween a trough with a Vee bottom in cross section sloping downwardly toward said coin receiving opening, said spring plates being disposed above said guide members and, at the time of insertion of a bill by the insertion plate, being forced apart along said Vee bottom to permit passage therethrough of said bill and insertion plate, whereby, when a coin or the like is dropped into the slot, said coin or the like is guided along the sloping trough toward and into said coin receiving opening to be received in said coin receiving chamber.

9. A money-collecting device according to claim 1 which is dismountably mounted in the manner of a drawer below the table top of a gaming table in a place such as a casino, an insertion opening for insertion downward therethrough of money and the like being formed through the table top to be immediately above and aligned with said slot in said box structure when said money-collecting device is thus mounted.

* * * * *